US012221736B2

(12) United States Patent
Hombroek et al.

(10) Patent No.: US 12,221,736 B2
(45) Date of Patent: Feb. 11, 2025

(54) LAUNDRY WASHING MACHINE WITH DYNAMIC DRAIN SYSTEM

(71) Applicant: Midea Group Co., Ltd., Foshan (CN)

(72) Inventors: Phillip C. Hombroek, Louisville, KY (US); Alexi Blaise Poth, Louisville, KY (US); John Kenneth Hooker, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 468 days.

(21) Appl. No.: 17/547,703

(22) Filed: Dec. 10, 2021

(65) Prior Publication Data

US 2023/0183904 A1 Jun. 15, 2023

(51) Int. Cl.

| | |
|---|---|
| ***D06F 23/02*** | (2006.01) |
| ***D06F 23/04*** | (2006.01) |
| ***D06F 33/40*** | (2020.01) |
| ***D06F 33/42*** | (2020.01) |
| ***D06F 39/08*** | (2006.01) |
| *D06F 103/02* | (2020.01) |
| *D06F 103/06* | (2020.01) |
| *D06F 103/18* | (2020.01) |
| *D06F 105/08* | (2020.01) |
| *D06F 105/48* | (2020.01) |
| *D06F 105/56* | (2020.01) |

(52) U.S. Cl.

CPC ..... *D06F 33/42* (2020.02); *D06F 23/02* (2013.01); *D06F 23/04* (2013.01); *D06F 33/40* (2020.02); *D06F 39/085* (2013.01); *D06F 39/087* (2013.01); *D06F 2103/02* (2020.02); *D06F 2103/06* (2020.02); *D06F 2103/18* (2020.02); *D06F 2105/08* (2020.02); *D06F 2105/48* (2020.02); *D06F 2105/56* (2020.02)

(58) Field of Classification Search

USPC ..... 68/3 R, 12.01, 12.02, 13 R, 207

See application file for complete search history.

(56) References Cited

U.S. PATENT DOCUMENTS

| | | | |
|---|---|---|---|
| 4,257,708 | A | 3/1981 | Fukuda |
| 4,889,644 | A | 12/1989 | Amberg et al. |

(Continued)

FOREIGN PATENT DOCUMENTS

| | | | |
|---|---|---|---|
| CN | 1378005 | A | 11/2002 |
| CN | 1880543 | A | 12/2006 |

(Continued)

OTHER PUBLICATIONS

Leveraging Lasers—Retrieved from: https://www.finisar.com/sites/default/files/resources/Appliance%20Design-VCSEL%20turbidity%20Sensor.pdf Dec. 21, 2015.

(Continued)

*Primary Examiner* — Levon J Shahinian

(74) *Attorney, Agent, or Firm* — Gray Ice Higdon

(57) ABSTRACT

A laundry washing machine and method control a time or duration of a drain operation at least in part based upon a type of a load being washed in the laundry washing machine. By doing so, the amount of time in which a drain operation is performed may be customized for different types of loads, and in many instances, may reduce the amount of noise and/or energy consumption associated with draining a wash tub during a wash cycle.

15 Claims, 5 Drawing Sheets

(56) References Cited

U.S. PATENT DOCUMENTS

| | | | |
|---|---|---|---|
| 4,986,093 | A | 1/1991 | Pastryk et al. |
| 4,987,627 | A | 1/1991 | Cur et al. |
| 5,031,427 | A | 7/1991 | Pastryk et al. |
| 5,161,393 | A | 11/1992 | Payne et al. |
| 5,167,722 | A | 12/1992 | Pastryk et al. |
| 5,373,714 | A | 12/1994 | Wada |
| 5,555,583 | A | 9/1996 | Berkcan |
| 5,560,060 | A | 10/1996 | Dausch et al. |
| 5,589,935 | A | 12/1996 | Biard |
| 5,603,233 | A | 2/1997 | Erickson et al. |
| 5,611,867 | A | 3/1997 | Cooper et al. |
| 5,731,868 | A | 3/1998 | Okey et al. |
| 5,737,790 | A | 4/1998 | Badger et al. |
| 5,768,729 | A | 6/1998 | Cracraft |
| 5,897,672 | A | 4/1999 | Badami et al. |
| 6,023,950 | A | 2/2000 | Battistella |
| 6,536,243 | B2 | 3/2003 | Sasano |
| 6,842,929 | B2 | 1/2005 | Kim et al. |
| 7,062,810 | B2 | 6/2006 | Hardaway et al. |
| 7,380,303 | B2 | 6/2008 | Bellinetto et al. |
| 7,392,813 | B2 | 7/2008 | Bertram et al. |
| 7,421,752 | B2 | 9/2008 | Donadon et al. |
| 7,451,510 | B2 | 11/2008 | Lee |
| 7,958,584 | B2 | 6/2011 | Suel, II et al. |
| 8,505,139 | B2 | 8/2013 | Vanhazebrouck et al. |
| 8,627,524 | B2 | 1/2014 | Urbanet et al. |
| 8,719,985 | B2 | 5/2014 | Park et al. |
| 8,834,646 | B2 | 9/2014 | Bewley, Jr. |
| 8,910,335 | B2 | 12/2014 | Kim et al. |
| 9,139,946 | B2 | 9/2015 | Dogan et al. |
| 9,243,987 | B2 | 1/2016 | Chanda et al. |
| 9,534,338 | B2 | 1/2017 | Fagstad et al. |
| 10,161,074 | B2 | 12/2018 | Hombroek et al. |
| 10,161,075 | B2 | 12/2018 | Hombroek et al. |
| 10,358,760 | B2 | 7/2019 | Hombroek et al. |
| 10,400,378 | B2 | 9/2019 | Driussi |
| 10,612,175 | B2 | 4/2020 | Hombroek |
| 10,619,286 | B2 | 4/2020 | Pesavento et al. |
| 2001/0002542 | A1 | 6/2001 | Sasano |
| 2003/0196278 | A1 | 10/2003 | Durfee |
| 2004/0244433 | A1 | 12/2004 | Lee et al. |
| 2005/0022317 | A1 | 2/2005 | Shaffer |
| 2005/0166334 | A1 | 8/2005 | Clouser |
| 2007/0113595 | A1 | 5/2007 | Harwood |
| 2008/0041115 | A1 | 2/2008 | Kanazawa et al. |
| 2008/0276964 | A1 | 11/2008 | Hendrickson et al. |
| 2010/0095465 | A1 | 4/2010 | Kim et al. |
| 2012/0060299 | A1 | 3/2012 | Kim et al. |
| 2012/0103026 | A1 | 5/2012 | Oyama et al. |
| 2012/0312055 | A1 | 12/2012 | Fagstad et al. |
| 2013/0125595 | A1 | 5/2013 | Seo et al. |
| 2013/0145563 | A1 | 6/2013 | Kang |
| 2013/0312202 | A1 | 11/2013 | Balinski et al. |
| 2014/0259441 | A1 | 1/2014 | Fulmer et al. |
| 2014/0123400 | A1 | 5/2014 | Gasparini et al. |
| 2014/0123403 | A1 | 5/2014 | Zattin et al. |
| 2014/0326067 | A1 | 11/2014 | Chanda et al. |
| 2015/0000047 | A1 | 1/2015 | Obregon |
| 2018/0002858 | A1* | 1/2018 | Hombroek ..... D06F 33/37 |
| 2018/0087198 | A1 | 3/2018 | Kim et al. |
| 2019/0112747 | A1 | 4/2019 | Hombroek |
| 2019/0264372 | A1 | 8/2019 | Kessler et al. |
| 2019/0352834 | A1 | 11/2019 | Clara et al. |
| 2020/0071871 | A1 | 3/2020 | Kim et al. |
| 2021/0381150 | A1 | 12/2021 | Hombroek et al. |
| 2023/0183903 | A1 | 6/2023 | Hombroek |
| 2023/0416966 | A1 | 12/2023 | Hombroek et al. |

FOREIGN PATENT DOCUMENTS

| | | | |
|---|---|---|---|
| CN | 100532689 | C | 8/2009 |
| CN | 101935936 | A | 1/2011 |
| CN | 102199854 | A | 9/2011 |
| CN | 102199855 | A | 9/2011 |
| CN | 102260981 | A | 11/2011 |
| CN | 102465421 | A | 5/2012 |
| CN | 103306096 | A | 9/2013 |
| CN | 103334257 | | 10/2013 |
| CN | 103334258 | | 10/2013 |
| CN | 103485121 | A | 1/2014 |
| CN | 203514043 | | 4/2014 |
| CN | 103797175 | A | 5/2014 |
| CN | 103898711 | | 7/2014 |
| CN | 104233700 | A | 12/2014 |
| CN | 104790179 | A | 7/2015 |
| CN | 105063956 | | 11/2015 |
| CN | 109477272 | A | 3/2019 |
| CN | 109554889 | A | 4/2019 |
| CN | 110512394 | A | 11/2019 |
| DE | 2844755 | | 4/1980 |
| DE | 102008055643 | A1 | 5/2010 |
| DE | 102010029890 | A1 | 12/2011 |
| EP | 0178031 | | 4/1986 |
| EP | 0787848 | A1 | 8/1997 |
| EP | 0962576 | | 12/1999 |
| EP | 2518203 | | 10/2012 |
| EP | 2752514 | A1 | 7/2014 |
| GB | 2262363 | | 6/1993 |
| JP | 04054998 | A | 6/1990 |
| JP | H0332699 | A | 2/1991 |
| JP | H04122384 | A | 4/1992 |
| JP | H06218183 | A | 8/1994 |
| JP | H07171289 | A | 7/1995 |
| JP | H08141273 | A | 6/1996 |
| JP | 2011200526 | | 10/2011 |
| KR | 100971018 | B1 | 7/2010 |
| KR | 20140019551 | A | 2/2014 |
| WO | 2007003593 | | 1/2007 |
| WO | WO2012089605 | A1 | 7/2012 |
| WO | WO2014205861 | A1 | 1/2016 |
| WO | WO2018001077 | A1 | 1/2018 |

OTHER PUBLICATIONS

U.S. Patent Office; Office Action issued in U.S. Appl. No. 15/198,890 dated Feb. 9, 2018.

U.S. Patent Office; Restriction Requirement issued in U.S. Appl. No. 15/198,883 dated Jan. 18, 2018.

U.S. Patent Office; Non-Final Office Action issued in U.S. Appl. No. 15/198,971 dated Apr. 2, 2018.

U.S. Patent Office; Restriction Requirement issued in U.S. Appl. No. 15/198,865 dated Mar. 27, 2018.

U.S. Patent Office; Office Action issued in U.S. Appl. No. 15/198,883 dated Apr. 20, 2018.

U.S. Patent Office; Office Action issued in U.S. Appl. No. 15/198,865 dated Jun. 13, 2018.

International Search Report and Written Opinion issued in Application No. PCT/CN2017/087805 dated Sep. 20, 2017.

International Search Report and Written Opinion issued in Application No. PCT/CN2017/087804 dated Sep. 4, 2017.

International Search Report and Written Opinion issued in Application No. PCT/CN2017/087800 dated Jul. 27, 2017.

International Search Report and Written Opinion issued in Application No. PCT/CN2017/087799 dated Sep. 13, 2017.

U.S. Patent Office; Final Office Action issued in U.S. Appl. No. 15/198,971 dated Oct. 9, 2018.

U.S. Patent Office; Notice of Allowance issued in U.S. Appl. No. 15/198,890 dated Sep. 6, 2018.

U.S. Patent Office; Notice of Allowance issued in U.S. Appl. No. 15/198,883 dated Sep. 12, 2018.

U.S. Patent Office; Notice of Allowance issued in U.S. Appl. No. 16/355,690 dated Nov. 30, 2021.

U.S. Patent Office; Advisory Action issued in U.S. Appl. No. 15/198,971 dated Jan. 22, 2019.

U.S. Patent Office; Notice of Allowance issued in U.S. Appl. No. 15/198,865 dated Jan. 24, 2019.

U.S. Patent Office; Notice of Allowance issued in U.S. Appl. No. 15/198,971 dated Mar. 7, 2019.

U.S. Patent Office; Office Action issued in U.S. Appl. No. 16/229,521 dated May 26, 2020.

(56) References Cited

OTHER PUBLICATIONS

U.S. Patent Office; Notice of Allowance issued in U.S. Appl. No. 16/229,521 dated Nov. 3, 2020.
U.S. Patent Office; Office Action issued in U.S. Appl. No. 16/355,690 dated Jun. 1, 2021.
International Search Report and Written Opinion issued in Application No. PCT/CN2021/098144 dated Aug. 30, 2021.
Ko, Jason Y., United States Patent and Trademark Office, Notice of Allowance issued in U.S. Appl. No. 17/126,094, 72 pages, dated Sep. 27, 2023.
Ayalew, Tinsae B., United States Patent and Trademark Office, Office Action issued in U.S. Appl. No. 17/851,218, 41 pages, dated Oct. 23, 2023.
Ayalew, Tinsae B., United States Patent and Trademark Office, Final Office Action issued in U.S. Appl. No. 17/851,218, 17 pages, dated Feb. 6, 2024.
Shahinian, Levon J., United States Patent and Trademark Office, Non-Final Office Action issued in U.S. Appl. No. 17/825,662, 37 pages, dated Aug. 1, 2024.
Ayalew, Tinsae, B., United States Patent and Trademark Office, Notice of Allowance issued in U.S. Appl. No. 17/851,218, 23 pages, dated Jul. 8, 2024.

* cited by examiner

130

| 134 Load Type | 140 Spin Speed(s) | | | 136 Drain Time(s) | | | 138 Extra Time(s) | | |
|---|---|---|---|---|---|---|---|---|---|
| Load Type 1 | Spin Speed 1 | ooo | Spin Speed Z | Drain Time 1 | ooo | Drain Time X | Extra Time 1 | ooo | Extra Time Y |
| Load Type 2 | Spin Speed 1 | ooo | Spin Speed Z | Drain Time 1 | ooo | Drain Time X | Extra Time 1 | ooo | Extra Time Y |
| o o o | o o o | | o o o | o o o | | o o o | o o o | | o o o |
| Load Type W | Spin Speed 1 | ooo | Spin Speed Z | Drain Time 1 | ooo | Drain Time X | Extra Time 1 | ooo | Extra Time Y |

132

LAUNDRY WASHING MACHINE WITH DYNAMIC DRAIN SYSTEM

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for an automated manner of optimizing the performance of a laundry washing machine for different types of loads, as well as reducing the burden on users when interacting with a laundry washing machine.

One particular area in which laundry washing machine performance may be sub-optimal is draining a wash tub. During a spin operation, for example, many laundry washing machines run the drain during the entire spin operation to ensure that no water is retained in the wash tub when the spin operation is complete, as well as to minimize water friction between the wash tub and the rotating wash basket, which could otherwise place unneeded stress on the wash motor. Running the drain, however, is noisy and energy inefficient, so a need generally exists in the art for a manner of minimizing the amount of time that a drain is being run.

SUMMARY

The invention addresses these and other problems associated with the art by providing a laundry washing machine and method that control a time or duration of a drain operation at least in part based upon a type of a load being washed in the laundry washing machine. By doing so, the amount of time in which a drain operation is performed may be customized for different types of loads, and in many instances, may reduce the amount of noise and/or energy consumption associated with draining a wash tub during a wash cycle.

Therefore, consistent with one aspect of the invention, a laundry washing machine may include a wash tub disposed within a housing, a drain system configured to drain fluid from the wash tub, and a controller coupled to the drain system and configured to initiate a drain operation with the drain system to drain fluid from the wash tub during a wash cycle. The controller is further configured to select a load type for a load disposed in the wash tub from among a plurality of load types, and control a time of the drain operation at least in part based upon the selected load type.

In some embodiments, the drain system includes a pump, and the controller is configured to control the time of the drain operation by operating the pump for the controlled time. Also, in some embodiments, the controller is configured to control the time of the drain operation at least in part based upon the selected load type by retrieving a predetermined time associated with the selected load type. In addition, some embodiments may further include a data structure storing at least one time for each of the plurality of load types, and the controller is configured to retrieve the predetermined time associated with the selected load type by accessing the data structure.

Further, in some embodiments, the controller is configured to control the time of the drain operation at least in part based upon the selected load type by controlling the drain system to drain fluid from the wash tub for a predetermined time associated with the selected load type, thereafter determining if the wash tub is empty, if the wash tub is determined to be empty, ending the drain operation, and if the wash tub is not determined to be empty, controlling the drain system to drain fluid from the wash tub for an extended time. In some embodiments, the controller is further configured to end the drain operation in response to determining that the drain operation has met a maximum time criterion. In addition, in some embodiments, the controller is further configured to signal an error in response to determining that the drain operation has met the maximum time criterion.

In some embodiments, the controller is further configured to determine the extended time based at least in part on an amount of fluid sensed in the wash tub when determining if the wash tub is empty. In addition, in some embodiments, the controller is further configured to determine the extended time based at least in part on the selected load type. Moreover, in some embodiments, the controller is configured to determine the extended time based at least in part on the selected load type by sensing a fluid level in the wash tub using a pressure sensor, selecting a first predetermined time for the extended time in response to the sensed fluid level meeting a first fluid level criterion or the selected load type meeting a first load type criterion, selecting a second predetermined time for the extended time in response to the sensed fluid level meeting a second fluid level criterion or the selected load type meeting a second load type criterion, and selecting a third predetermined time for the extended time in response to the selected load type not meeting any of the first and second fluid level criteria and the first and second load type criteria.

In some embodiments, the controller is configured to initiate the drain operation during a spin operation, and the controller is further configured to control a spin profile used in the spin operation at least in part based on the selected load type. Moreover, in some embodiments, the spin profile defines a plurality of spin segments and the spin profile includes a first spin speed associated with a first spin segment of the plurality of spin segments, the drain operation is a first drain operation associated with the first spin segment and the time of the drain operation is a first time of the first drain operation, and the controller is further configured to initiate a second drain operation during a second segment of the plurality of spin segments, control a second spin speed for the second spin segment at least in part based on the selected load type, and control a second time of the second drain operation at least in part based upon the selected load type. Some embodiments may also include a data structure storing, for each of the plurality of load types, a plurality of spin speeds and a plurality of times for drain operations, and the controller is further configured to determine the first and second spin speeds and the first and second times by accessing a portion of the data structure associated with the selected load type.

In some embodiments, the controller is configured to select the load type by automatically and dynamically selecting the load type based at least in part on one or more times determined during an initial fill phase of the wash cycle. In addition, in some embodiments, the controller is configured to automatically and dynamically select the load type based at least in part on the one or more times determined during the initial fill phase by controlling a water inlet to dispense water into the wash tub, determining a first time at which a predetermined fluid level is sensed in the wash tub while the controller controls the water inlet to dispense water into the wash tub, and determining a peak time a stabilization of fluid level is sensed after the controller controls the water inlet to stop dispensing water into the wash tub.

Consistent with another aspect of the invention, a method may be provided for operating a laundry washing machine of a type including a housing, a wash tub disposed in the housing, and a drain system configured to drain fluid from the wash tub. The method may include selecting a load type for a load disposed in the wash tub from among a plurality of load types, initiating a drain operation with the drain system to drain fluid from the wash tub, and controlling a time of the drain operation at least in part based upon the selected load type.

Consistent with another aspect of the invention, a laundry washing machine may include a wash tub disposed within a housing, a wash basket disposed within the wash tub, a drive system configured to rotate the wash basket, and a controller coupled to the drive system and configured to initiate a spin operation with the drive system to spin a load disposed in the wash basket during a wash cycle. The controller is further configured to select a load type for the load from among a plurality of load types, and control a spin profile of the spin operation at least in part based upon the selected load type.

In some embodiments, the spin profile defines a spin speed, and the controller is configured to control the spin profile of the spin operation at least in part based upon the selected load type by controlling the drive system at least in part based upon the spin speed defined by the spin profile. Moreover, in some embodiments, the spin profile defines a plurality of spin segments and the spin profile includes a plurality of spin speeds respectively associated with the plurality of spin segments, and the controller is configured to control the spin profile of the spin operation at least in part based upon the selected load type by controlling the drive system at least in part based upon the associated spin speed defined in the spin profile during each of the plurality of spin segments. In addition, some embodiments may further include a drain system configured to drain fluid from the wash tub, the spin profile further defines at least one drain operation time for each of the plurality of load types, and the controller is further configured to control a time of a drain operation performed during the spin operation at least in part based upon the at least one drain operation time for the selected load type.

Other embodiments may include various methods of operating a laundry washing machine utilizing the various operations described above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
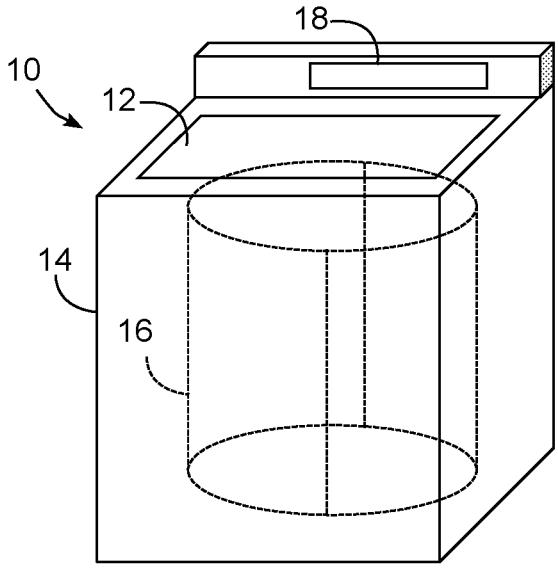
FIG. 1 is a perspective view of a top-load laundry washing machine consistent with some embodiments of the invention.

Embodiments consistent with the invention may incorporate a dynamic drain system that controls a drain operation performed by a laundry washing machine based at least in part on a type of load being washed in the laundry washing machine. In particular, in some embodiments consistent with the invention, a laundry washing machine may include in part a dynamic drain system capable of controlling a time or duration of a drain operation at least in part based upon the load type, which in some instances may reduce the amount of noise and/or energy consumption associated with draining a wash tub during a wash cycle.

In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. In the illustrated embodiment, load types are principally distinguished based upon different fabric types (e.g., natural, cotton, wool, silk, synthetic, polyester, permanent press, wrinkle resistant, blends, etc.), and optionally, based on different article types (e.g., garments, towels, bedding, delicates, etc.). It will be appreciated, however, that load types may be defined based upon additional or alternative categorizations, e.g., color (colors, darks, whites, etc.); durability (delicates, work clothes, etc.), soil level (lightly soiled, normally soiled, heavily soiled loads, etc.), among others. Load types may also represent categories of loads that are unnamed, and that simply represent a combination of characteristics for which certain combinations of operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, a duration of a drain operation, etc.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
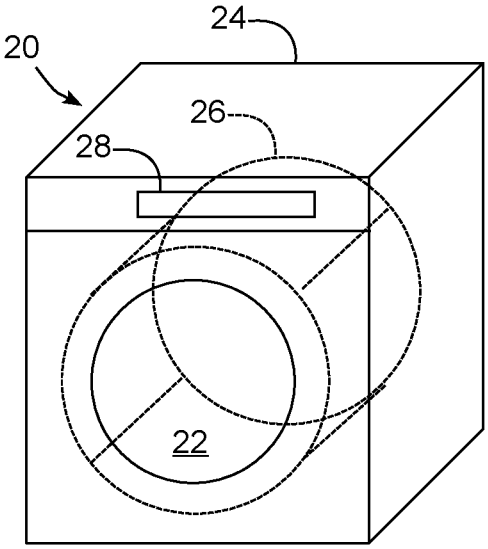
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
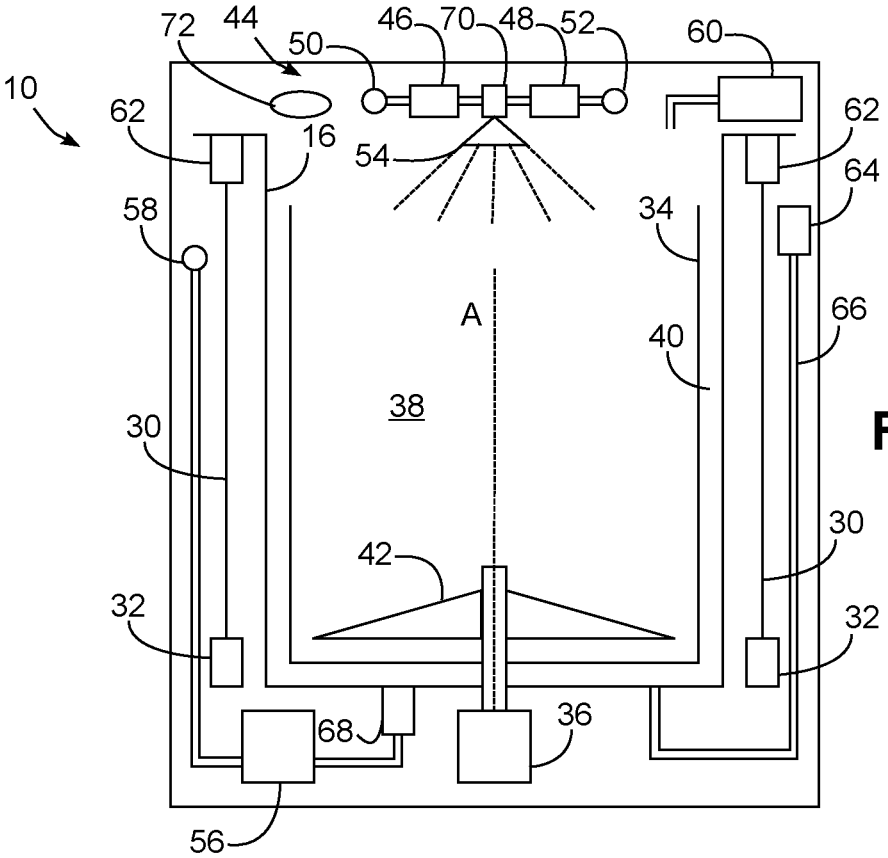
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump or drain system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, to support automated load type selection or otherwise to support automated selection of various operational settings, laundry washing machine 10 also includes a weight sensing system, and optionally various additional sensors such as a fluid level sensor, a turbidity sensor, a flow sensor, a color detection sensor, etc., as will be discussed in greater detail below. A weight sensing system may be used to sense the mass or weight of the contents of wash tub 16, e.g., when the wash tub is filled with water or even prior to filling the wash tub. In the illustrated embodiment, for example, a weight sensing system consistent with the invention may be implemented in laundry washing machine 10 at least in part using one or more weight sensors 62 that support wash tub 16 on one or more corresponding support rods 30. Each weight sensor 62 may be an electro-mechanical sensor that outputs a signal that varies with a displacement based on applied force (here, also representative of load or weight), and thus outputs a signal that varies with the weight of the contents of wash tub 16. Multiple weight sensors 62 may be used in some embodiments, and in some embodiments, the weight sensors may be implemented using load cells, while in other embodiments, other types of transducers or sensors that generate a signal that varies with applied force, e.g., strain gauges, may be used. Furthermore, while weight sensors 62 are illustrated as supporting wash tub 16 on support rods 30, the weight sensors may be positioned elsewhere in a laundry washing machine to generate one or more signals that vary in response to the weight of the contents of wash tub 16. In some embodiments, for example, transducers may be used to support an entire laundry washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensing system may also be used for vibration sensing purposes, e.g., to detect excessive vibrations resulting from an out-of-balance load. In other embodiments, however, no vibration sensing may be used, while in other embodiments, separate sensors may be used to sense vibrations. Further, in some embodiments, a single weight sensor employing a load cell or other transducer may be used (e.g., disposed proximate a corner of the housing), and the wash basket may be rotated when sensing the weight of the load such that a weight may be determined by averaging multiple force values captured during rotation of the wash basket.

A fluid level sensor may be used in some embodiments to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub. It will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, float sensors, laser sensors, etc.

Additional sensors may also be incorporated into laundry washing machine 10. For example, in some embodiments, a turbidity sensor 68 may be used to measure the turbidity or clarity of the fluid in wash tub 16, e.g., to sense the presence or relative amount of various wash-related products such as detergents or fabric softeners and/or to sense the presence or relative amount of soil in the fluid. Further, in some embodiments, turbidity sensor 68 may also measure other characteristics of the fluid in wash tub 16, e.g., conductivity and/or temperature. In other embodiments, separate sensors may be used to measure turbidity, conductivity and/or temperature, and further, other sensors may be incorporated to measure additional fluid characteristics. In other embodiments, no turbidity sensor may be used.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

In some instances, a color detection sensor 72 may be used to capture color composition data of one or more items of a load. In some embodiments, the color detection sensor 72 may be positioned to capture the color composition data as items are added to the wash tub 16. In some embodiments, the color detection sensor 72 may be an image sensor, or a camera.

Figure 4:
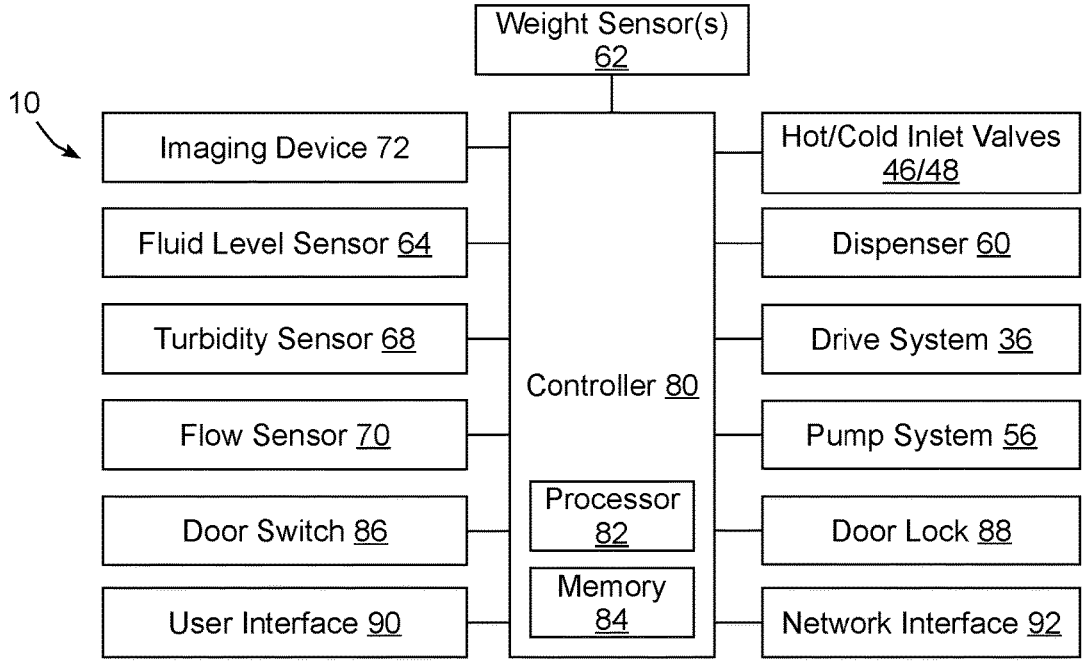
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors 82 and a memory 84 within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80. Controller 80 may also be implemented as a microcontroller in some embodiments, and as such these terms are used interchangeably herein. Controller 80 may also include specialized circuit logic in some embodiments, which may be integrated into one or more integrated circuits in some embodiments, including into an integrated circuit that also incorporates one or more processors and/or memory (also referred to herein as a processor integrated circuit) and/or which may be separate from any integrated circuit (e.g., including logic circuitry on the same or a different module or circuit board).

As shown in FIG. 4, controller 80 may be interfaced with various components, including the aforementioned drive system 36, hot/cold inlet valves 46, 48, drain or pump system 56, weight sensor(s) 62, fluid flow sensor 64, turbidity sensor 68, and flow sensor 70. In addition, controller 80 may be interfaced with additional components such as a door switch 86 that detects whether door 12 is in an open or closed position and a door lock 88 that selectively locks door 12 in a closed position. Moreover, controller 80 may be coupled to a user interface 90 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 92, e.g., for interfacing with external devices via wired and/or wireless networks such as Ethernet, Bluetooth, NFC, cellular and other suitable networks, including external devices such as end user computers, mobile phones, tablets, etc. and/or one or more cloud services. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Dynamic Drain System

In many modern laundry washing machines, drains are typically run throughout any instance of a spin operation to ensure all water is being drained and not retained in the wash tub. The drain typically is not tightly controlled and is simply on the entire time a spin sequence is occurring. This is generally done to avoid water friction between the wash tub and the wash basket, as water friction can lead to unneeded stress on the wash motor which in some instances result in performance deterioration over time. Drain pumps can also generate electronic noise, which can cause interference with any software communications for components like the motor/inverter or a graphical user interface. Relatively long drain times are therefore very common, and can lead to excess noise and excess energy being consumed. The excess noise is primarily driven by a cavitation noise after water has been sufficiently removed from the washer tub, pump and corresponding water drain lines, and on some machines this cavitation noise can last for minutes.

Moreover, while it may be possible in some circumstances to monitor fluid level in a wash tub and use the sensed fluid level to determine when the wash tub is empty and the drain may be shut off, it has been found that monitoring fluid level alone generally is insufficient to properly time a drain shut off. In many instances, a pressure sensor is used to sense fluid level; however, due to the positioning of the pressure sensor, detection of an empty wash tub can be unreliable. Moreover, for some loads, e.g., large loads of highly absorbent fabrics, even if an empty wash tub is sensed, water will continue to be released from the load and into the wash tub.

Embodiments consistent with the invention, on the other hand, may address these prior shortcomings by controlling the time or duration of a drain operation performed by a drain system at least in part based upon a load type that has been selected from the load being washed. The load type may, for example, be used in some instances to determine a predetermined time to run the drain operation, and the predetermined time may be a constant value associated with the selected load type. In other instances, the load type may be used with one or more additional factors to control the time of a drain operation. For example, additional load characteristics such as load weight may be used, such that the time of a drain operation is based upon both load type and load size. In addition, as will become more apparent below, fluid level, e.g., as sensed by a fluid level sensor, a pressure sensor, etc., may also be used in combination with a selected load type, in some instances as a primary factor, while in other instances as a confirmation that the load type-based time has been sufficient. As will also become more apparent below, load type and/or fluid level may also be used to determine a time or duration to extend a drain operation, e.g., when it is detected that additional time is required for a drain operation after a load type-based time has elapsed.

In addition, selection of a load type in some embodiments may be based on user input, e.g., user selection through a user interface of a particular type of load, based on a fabric and/or garment type selection, e.g., cottons, polyesters, towels, bedding, etc. In other embodiments, however, selection of a load type may be based on an automated load type selection algorithm, and may be based in part on analysis of various characteristics of a load placed in a wash tub by a user. Several suitable automated load type selection algorithms are described, for example, in U.S. Pat. Nos. 10,273,622 and 10,612,175, as well as U.S. patent application Ser. No. 16/893,328, filed on Jun. 4, 2020 by Hombroek et al. and U.S. patent application Ser. No. 17/470,301, filed on Sep. 9, 2021 by Hooker et al. (all of which are assigned to Midea Group Co., Ltd. and are incorporated by reference herein), although it will be appreciated that other automated load type selection algorithms may be used in other embodiments.

In some embodiments, a load type may be automatically and dynamically selected during a wash cycle, and based at least in part on one or more weights sensed by the weight sensing system and/or one or more images captured by an imaging device. In particular, in some embodiments, a laundry washing machine may include in part a fluid level sensor configured to sense a fluid level in the wash tub and a controller configured to dynamically select a load type for a load disposed in the wash tub from among a plurality of load types based at least in part on a first time at which the fluid level sensor senses a predetermined fluid level while the controller controls a water inlet to dispense water into the wash tub and a peak time at which the fluid level sensor senses a stabilization of fluid level after the controller controls the water inlet to stop dispensing water into the wash tub. In addition, in some embodiments, a controller of such a laundry washing machine may be configured to dynamically select a load type based at least in part on a plurality of times determined based upon fluid levels sensed by a fluid level sensor, but additionally with the controller configured to dynamically select the load type prior to sensing at least one of the plurality of times in response to determining that an earlier reached time among the plurality of times meets a predetermined criterion. In addition, in some embodiments, a load type may be dynamically selected during an initial fill phase of a wash cycle, i.e., the phase of a wash cycle in which water is first introduced into a wash tub, and generally prior to any agitation of the load and/or draining of fluid from the wash tub, and generally without any extended soaking of the load. It will be appreciated, however, that in some embodiments, a load may be agitated or at least rotated during a portion of the initial fill phase, e.g., to facilitate a determination of the weight of the load.

In one example embodiment, four different load types may be defined, a polyester load type that represents a load that is entirely or mostly comprised of polyester articles (which tend to be minimally absorbent), a cotton load type that is entirely or mostly comprised of cotton articles (which tend to be fairly absorbent), a towels load type that is entirely or mostly comprised of towels (which tend to be highly absorbent), and a mixed load type that, based upon a general absorbency, is likely comprised of some mixture of polyester and cotton articles. It will be appreciated, however, that the number and configurations of load types may vary in different embodiments, so the invention is not limited to the specific combination of load types described herein.

In addition, in such an embodiment, three times may be recorded during an initial fill phase based upon fluid levels in order to determine a load type. A first time, referred to as a sense time, is a time during the initial fill phase that a fluid level change is first sensed by the fluid level sensor, i.e., a first detected change in fluid level sensed by the fluid level sensor. It will be appreciated, in particular, that when water is first dispensed into the wash tub and onto the load, the fluid level sensor will initially not detect any water at the bottom of the wash tub for some period of time, and generally not until the articles in the load have become mostly saturated with water. Thus, as the absorbency of the load increases, the sense time will generally increase as well.

A second time, referred to as a fill time, is a time during the initial fill phase that the fluid level reaches a predetermined fluid level, e.g., a minimum fluid level for the initial fill, representing the minimum amount of water that would be recommended for the load regardless of type. In some embodiments, however, a fluid level different from a minimum fluid level may be used, and further while in some embodiments the predetermined fluid level may be a constant fluid level, in other embodiments the predetermined fluid level may be varied based upon weight and/or other load characteristics (e.g., based upon user input, such as soil level, load size, etc.). As with the sense time, the fill time also generally increases with the absorbency of the load.

A third time, referred to as a peak time, is a time during the initial fill phase that the fluid level stabilizes after water dispensing has been stopped or paused. In particular, it will be appreciated that after the water inlet is shut off, the fluid level in the wash tub will generally continue to increase as water drips from the load. The peak time may be measured based upon when the fluid level stabilizes, i.e., when the fluid level stops increasing. In some embodiments, this stabilization may be based upon sensing no change in the fluid level (or alternatively, a change below a predetermined threshold) for a predetermined stabilization duration, e.g., about 15 seconds. As with the sense and fill times, the peak time also generally increases with the absorbency of the load. Furthermore, the peak time may be adjusted in some embodiments to not include the stabilization duration, i.e., such that the peak time is representative of the time at which the fluid level ceased increasing.

It will be appreciated that in other embodiments, additional times may be used, and in some embodiments, only one of the first and second times may be used. Furthermore, where the load type may be determined from the first time alone, neither of the second or third times may need to be determined, and where the load type may be determined from the first and second times, the third time may not need to be determined.

In order to select from the aforementioned load types, a number of load type criteria may be defined. Furthermore, at least some of these various load type criteria may be load weight dependent, such that the criteria vary with load weight. It may be desirable, for example, to utilize linear equations of the form $y=mx+b$, where y is a threshold time or duration, x is the load weight, m is the rate at which the threshold time or duration increases as weight increases, and b is the y-intercept that best represents the data at realistic load sizes. In some embodiments, the linear equations may be empirically determined, and in some embodiments, other equations, e.g., polynomial or non-linear equations, may be used to represent the load type criteria. In other embodiments, load type criteria may be based on fuzzy logic or neural network-derived thresholds. Other manners of mapping the determined times to different load types will be appreciated by those of ordinary skill having the benefit of the instant disclosure.

In one example embodiment, six different load criteria may be used to map the sense, fill and peak times to the polyester, mixed, cotton and towel load types. In such an embodiment, the criteria associated with the sense and fill times may be based upon a duration from the start of dispensing water to the respective sense and fill times, and all may be based on linear equations that are function of the dry weight of the load. An additional criterion associated with the peak time may be based on a duration from the end of dispensing water (or alternatively, the fill time) to the peak time, and may not be a function of the dry weight of the load, but instead a constant threshold.

A first load criterion that may be used is a polyester sense criterion that may be used to determine when the sense time indicates that the load type is a polyester load type. In some embodiments, this criterion defines a weight-varying threshold that is met when the sense time or duration is below the threshold. A second load criterion that may be used is a towels sense criterion that may be used to determine when the sense time indicates that the load type is a towels load type. In some embodiments, this criterion defines a weight-varying threshold that is met when the sense time or duration is above the threshold. A third load criterion that may be used is a cotton sense criterion that may be used to determine when the sense time indicates that the load type is a cotton load type. In some embodiments, this criterion defines a weight-varying threshold that is met when the sense time or duration is above the threshold, but still below the weight-varying threshold for the towels sense criterion. A fourth load criterion that may be used is a cotton peak criterion that may be used to determine when the peak time indicates that the load type is a cotton load type. In some embodiments, this criterion defines a weight-independent threshold that is met when the peak time or duration is above the threshold, even when the cotton sense and towels sense criteria are not met by the sense time or duration. A fifth load criterion that may be used is a polyester fill criterion that may be used to determine when the fill time indicates that the load type is a polyester load type. In some embodiments, this criterion defines a weight-varying threshold that is met when the fill time or duration is below the threshold, even when the polyester sense criterion is not met by the sense time or duration.

Further, in some embodiments, a sixth load criterion may be used, and may be referred to as a mixed sense criterion that is used to determine whether to evaluate the cotton peak criterion or the polyester fill criterion based upon whether the sense time is more indicative of a cotton load type than a polyester load type. In some embodiments, this criterion defines a weight-varying threshold that, when the sense time or duration is above the threshold, indicates that the peak time should be evaluated against the cotton peak criterion to select between the cotton and mixed load types. In contrast, when the sense time or duration is below the threshold, the criterion indicates that the fill time should be evaluated against the polyester fill criterion to select between the polyester and mixed load types. If none of the first five load criteria is met, then the load is determined to be a mixed load type.

It will be appreciated that the various criteria discussed herein may be determined empirically in some embodiments, and may be specific to a particular laundry washing machine design. In addition, in some embodiments, additional factors may be considered in such criteria, e.g., water inlet flow rate, water temperature, etc.

Figure 5:
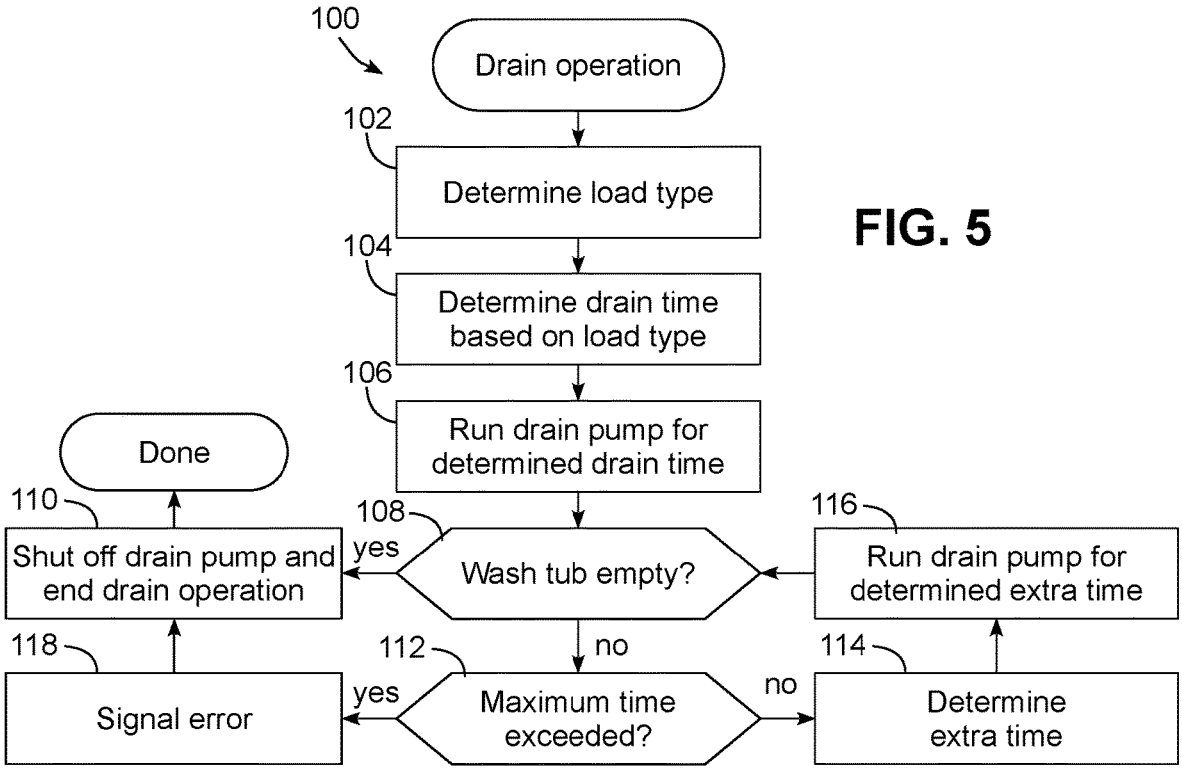
FIG. 5 is a flowchart illustrating an example sequence of operations for a drain operation capable of being performed by the laundry washing machines of FIGS. 1-4.

Now turning to FIG. 5, this figure illustrates an example sequence of operations 100 for performing a drain operation based at least in part on load type. In this embodiment, a drain time based at least partially on load type is initially used for the drain time, and then optionally extended if it is determined that the wash tub is not yet empty. In addition, a maximum time criterion is also used to ensure that the sequence does not run indefinitely.

In block 102, a load type is determined (e.g., using any of the various automated or manual load type selection operations as described above), and in block 104, a drain time is determined based on the load type. It will be appreciated therefore that the actual selection of a load type may occur well prior to the determination in block 102, such that the determination may include simply accessing a memory that stores the load type that was previously selected, e.g., during an initial fill. In various embodiments, the drain time may be a constant value associated with the selected load type, a value calculated using a formula based on load type (and in some instances, on additional factors such as load weight), a drain time retrieved from a lookup table or other data structure, etc. The mapping of drain time to load type may be determined empirically in some embodiments.

Next, in block 106, the drain system, e.g., the drain pump, is run for the drain time determined in block 104, and at the completion of this duration, block 108 determines whether the wash tub is empty (e.g., by sensing fluid level with a pressure sensor). If the wash tub is empty, control passes to block 110, where the drain pump is shut off and the drain operation is ended, and the sequence is complete. If the wash tub is not empty, however, block 108 passes control to block 112 to first determine if a maximum time criterion has been met, e.g., whether a maximum drain operation time has been exceeded. If not, control passes to block 114 to determine an extra drain time, and then to block 116 to run the drain pump for the determined extra time. Control then returns to block 108 to check if the wash tub is empty, such that one or more additional periods of time may be added to the drain operation until the wash tub is empty, up to the point in which the maximum time criterion has been met in block 112. If the criterion has been met, block 112 passes control to block 118 to signal an error (which in some instances, may be signaled to a user through the user interface, a mobile device, an electronic message, etc., or in other instances may be signaled only internally within the laundry washing machine and/or to a cloud service for diagnostic purposes). Control then passes to block 110 to shut off the drain pump and end the drain operation.

Returning to block 114, the determination of an extra time may vary in different embodiments. In some instances, for example, a constant extra time may be used, while in other instances, a load type-dependent extra time may be used. In still other instances, a sensed fluid level or amount may be used to determine the extra time, such that longer extra times will be added the more fluid that is left in the wash tub. Moreover, these factors may be combined in some instances, as well as with additional factors such as load weight, number of extra time segments added, etc. Other variations may be used in other embodiments, as will be appreciated by those of ordinary skill having the benefit of the instant disclosure.

Figures 6, 7:
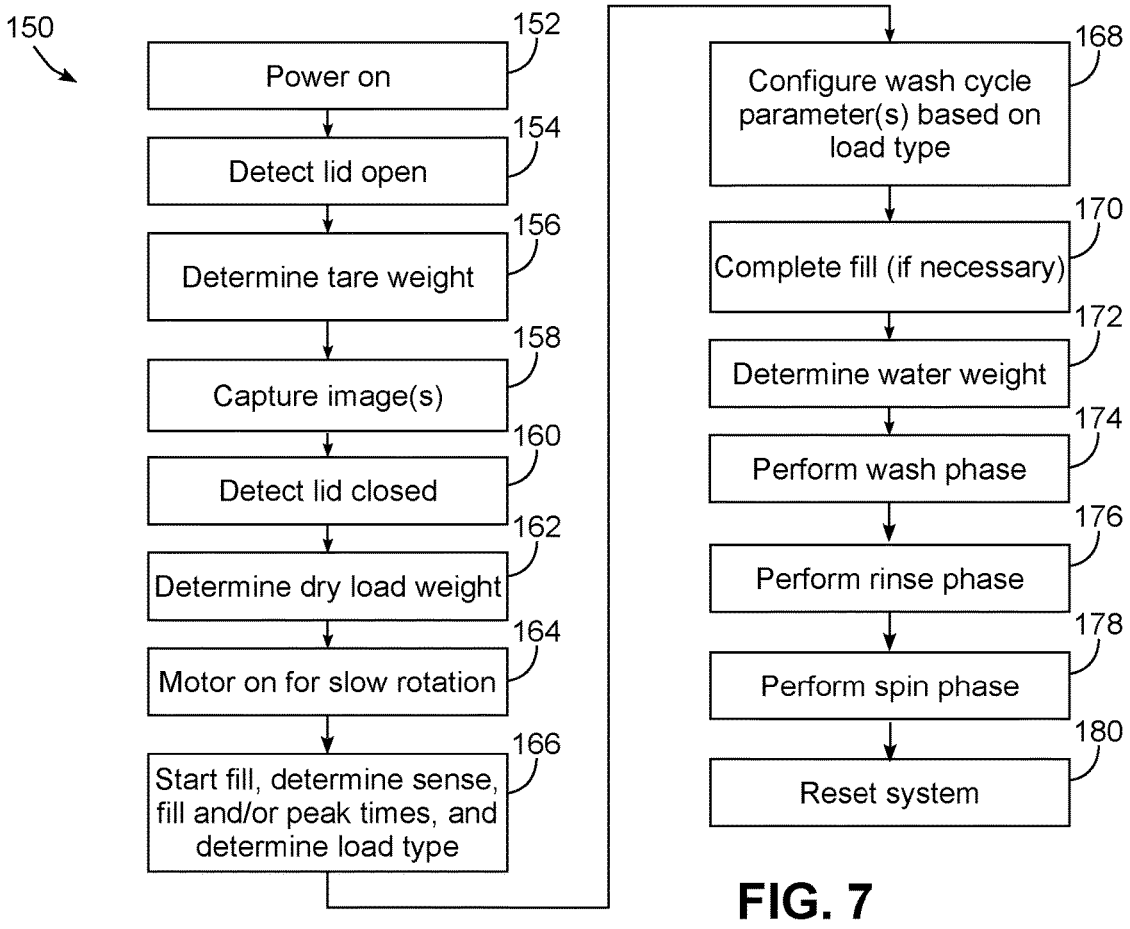
FIG. 6 illustrates an example load type data structure capable of being used by the laundry washing machines of FIGS. 1-4.
FIG. 7 is a flowchart illustrating an example sequence of operations for implementing a wash cycle in the laundry washing machines of FIGS. 1-4.

As noted above, the manner in which drain times and extra times may be determined may vary in different embodiments. In one embodiment, and as illustrated in FIG. 6, a data structure 130, e.g., a lookup table, may be used to determine these times. Data structure 130 includes a plurality of rows 132, one corresponding to each of a plurality of load types (load types 1 . . . W, where W>1) specified in a load type column 134. In some embodiments, load type may be associated with an index into the data structure, however, so no separate column 134 may be used.

Each row 132 also includes one or more drain time columns 136 (drain times 1 . . . X, where X>0) and one or more extra time columns 138 (extra times 1 . . . Y, where Y>0). In addition, in some instances, the drain and extra times may also be associated with one or more spin speeds or ramps defined in spin speed columns 140 (spin speeds 1 . . . Z, where Z>0). As will be discussed in greater detail below in connection with FIG. 8, in some embodiments it may be desirable to define a spin profile for each load type that incorporates multiple spin segments, each having an associated spin speed and drain time, and in some instances, its own extra time, such that a spin operation may be implemented by sequentially stepping through multiple spin segments. In other embodiments, extra times may not be associated with particular spin segments, but instead may define a sequence of extra times to step through whenever a non-empty wash tub is sensed at the end of a drain time.

It will be appreciated that a wide variety of alternate data structures may be used in other embodiments. For example, spin speeds, drain times and extra times may be defined in different data structures in some embodiments, and if spin operations are not load type-dependent, no load type-indexed spin speeds may be used. In some embodiments, for example, only a load type-dependent drain time may be defined for each load type, with no load type-based spin speed control and with any extra time determined in a manner that is not dependent upon load type, e.g., based on sensed fluid level or a constant time.

Now turning to FIG. 7, this figure illustrates an example sequence of operations 150 for implementing a wash cycle in a laundry washing machine using a dynamic drain system. A typical wash cycle includes multiple phases, including an initial fill phase where the wash tub is initially filled with water, a wash phase where a load that has been placed in the wash tub is washed by agitating the load with a wash liquor formed from the fill water and any wash products added manually or automatically by the washing machine, a rinse phase where the load is rinsed of detergent and/or other wash products (e.g., using a deep fill rinse where the wash tub is filled with fresh water and the load is agitated and/or a spray rinse where the load is sprayed with fresh water while spinning the load), and a spin phase where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

In sequence 150, for example, power on of the laundry washing machine may be performed in block 152, e.g., based upon user selection of a power button, and in block 154, an open lid may be detected. At this time, a tare weight, representative of the weight of an empty tub, may be determined in block 156. Next, in some embodiments, one or more images of the load may then be captured in block 158, with the image(s) used to determine a color composition of the load. Then, in block 160 closing of the lid may be detected. Next, a dry load weight may be determined (block 162), and then the motor that drives the wash basket may be turned on for slow rotation (block 164). In some embodiments, it may be desirable to determine the dry load weight while the wash basket is rotating.

Next, an initial fill phase may be initiated in block 166 in order to determine a load type, e.g., based at least in part on multiple times determined based upon various fluid levels sensed by a fluid level sensor during and after the dispensation of water into the wash tub. In some embodiments, the automatic and dynamic selection may be performed in response to user selection of a particular mode (e.g., an "automatic" mode), while in other embodiments, automatic and dynamic selection may be used for all wash cycles. In still other embodiments, automatic and dynamic selection may further be based upon additional input provided by a user, e.g., soil level, article type, fabric type, article durability, etc. The dynamic selection may be based in part on judging the absorptivity of the fabric in the load against the weight of the load. A dry weight may be determined for the load in some embodiments at the beginning of a washing cycle (e.g., at the beginning of the fill phase) using a weight sensor and prior to dispensing any water into the wash tub. Thereafter, water may be dispensed into the wash tub (e.g., by spraying the load to saturate the fabrics in the load), and fluid levels sensed by a fluid level sensor while dispensing water into the wash tub as well as after water dispensing has been paused or stopped may be used to determine multiple times that may be compared against various load type criteria to select a load type from among a plurality of different load types. The load type may then be used, for example, to determine if and how much additional water should be added for the initial fill, as well as other operational settings for the wash cycle.

In some embodiments, a first time at which the fluid level reaches a predetermined fluid level while dispensing water into the wash tub and a peak time at which the fluid level stabilizes after the dispensing of water into the wash tub has been stopped or paused may be used to categorize a load into one of multiple load types, as both times are affected in part by the absorbency of the articles in a load. In some instances, the first time alone may be able to categorize some loads, as, for example, the first time may be relatively short for loads containing only low absorbency fabrics such as polyesters and other synthetic materials, or may be relatively long for loads containing highly absorbent articles or fabrics such as cotton articles, bedding or towels. By incorporating the peak time into the determination, however, it has been found that additional loads may be appropriately categorized, e.g., loads where absorbency is such that the first time alone is unable to suitably categorize the load. In addition, in some embodiments, the first time may be a sense time where water is first detected by a fluid level sensor, and an additional time, e.g., a fill time at which the fluid level reaches another predetermined fluid level such as a desired minimum fill level while dispensing water into the wash tub, may also be incorporated into the determination to categorize additional loads. The dry weight of the load may also factor into the dynamic detection of load type, e.g., by determining appropriate criteria against which the times are compared when determining whether a load is appropriately categorized into a particular load type. Additional details regarding the use of such times and the sensed dry weight to determine load type may be found in the aforementioned U.S. patent application Ser. No. 16/893,328, which has been incorporated by reference herein. Furthermore, one suitable manner for determining the various weights discussed herein may be found in the aforementioned U.S. patent application Ser. No. 17/470,301, which has also been incorporated by reference herein.

Next, in block 168, the wash cycle is configured based upon the determined load type. Then, block 170 optionally dispenses an additional amount of water to complete the fill phase. For example, the additional amount of water may be selected to provide a total amount of dispensed water selected based upon load type or selected via a separate load size selection by the user. Thereafter, in block 172, a water weight may also be determined to determine the amount of water used during a cycle before the wash and rinse phases.

The wash cycle thereafter proceeds with one or more wash phases (block 174) one or more rinse phases (block 176) and one or more spin phases (block 178), with various operational settings in one or more of the phases controlled at least in part based on load type. The wash cycle is then complete, and the system is reset (block 180).

Figure 8:
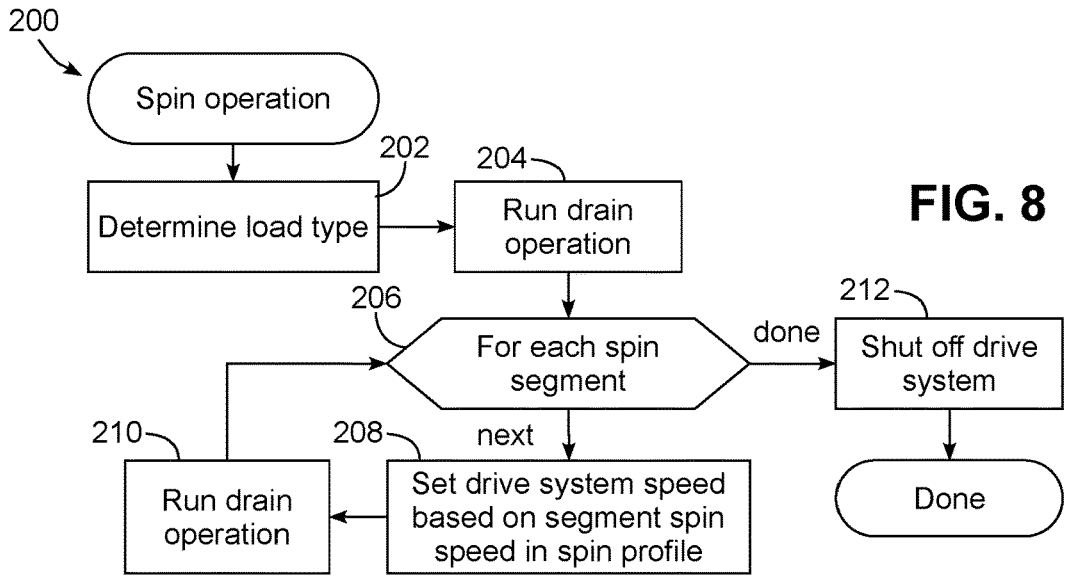
FIG. 8 is a flowchart illustrating an example sequence of operations for a spin operation capable of being performed by the laundry washing machines of FIGS. 1-4.

Next, with reference to FIG. 8, it may be desirable to perform one or more spin operations during the wash, rinse, and/or spin phases of the wash cycle described above in connection with FIG. 7. FIG. 8 in particular illustrates a sequence of operations 200 that controls a spin operation using a spin profile that is at least in part based on a load type, and that may use, for example, data structure 130 of FIG. 6 to access a spin profile associated with a selected load type. First, in block 202, a load type is determined, e.g., based on manual or automatic selection as described above. It will be appreciated therefore that the determination in block 202 may include simply accessing a memory that stores the load type that was previously determined during the initial fill. Next, in block 204, an initial drain operation is run, e.g., using a drain time specified in the row 132 of data structure 130 that is associated with the determined load type, and performing a drain operation as described above in connection with FIG. 5. Thereafter, a loop is initiated in block 206 to process each of a plurality spin segments, and for each spin segment, the drive system speed for rotating the wash basket is set based upon a spin speed or ramp specified for the spin segment in the row 132 of data structure 130 that is associated with the determined load type (block 208), and once the drive system reaches the desired speed, another drain operation is run using a drain time specified in the row 132 of data structure 130 that is associated with the determined load type (block 210). Thus, each spin segment may include a separate spin speed or ramp and/or drain time (and, if applicable extra time). Once all spin segments are performed, block 206 then passes control to block 212 to shut off the drive system, and the spin operation is complete.

It will be appreciated that in some embodiments, the duration of a spin segment need not necessarily be equal to the duration of the drain operation associated with that spin segment. The duration of a spin segment in some embodiments may be a fixed value in some instances, or may be a spin segment-specific and/or a load type-specific duration, such that, for at least a portion of a spin segment, the drain is off. For example, if a spin segment is rotating the wash basket at a high speed, it may be desirable to maintain the high speed spin with the drain off for at least a portion of the segment. It will also be appreciated that a data structure such as data structure 130 of FIG. 6 may include one or more spin segment durations stored therein to control the duration of each spin segment.

Figure 9:
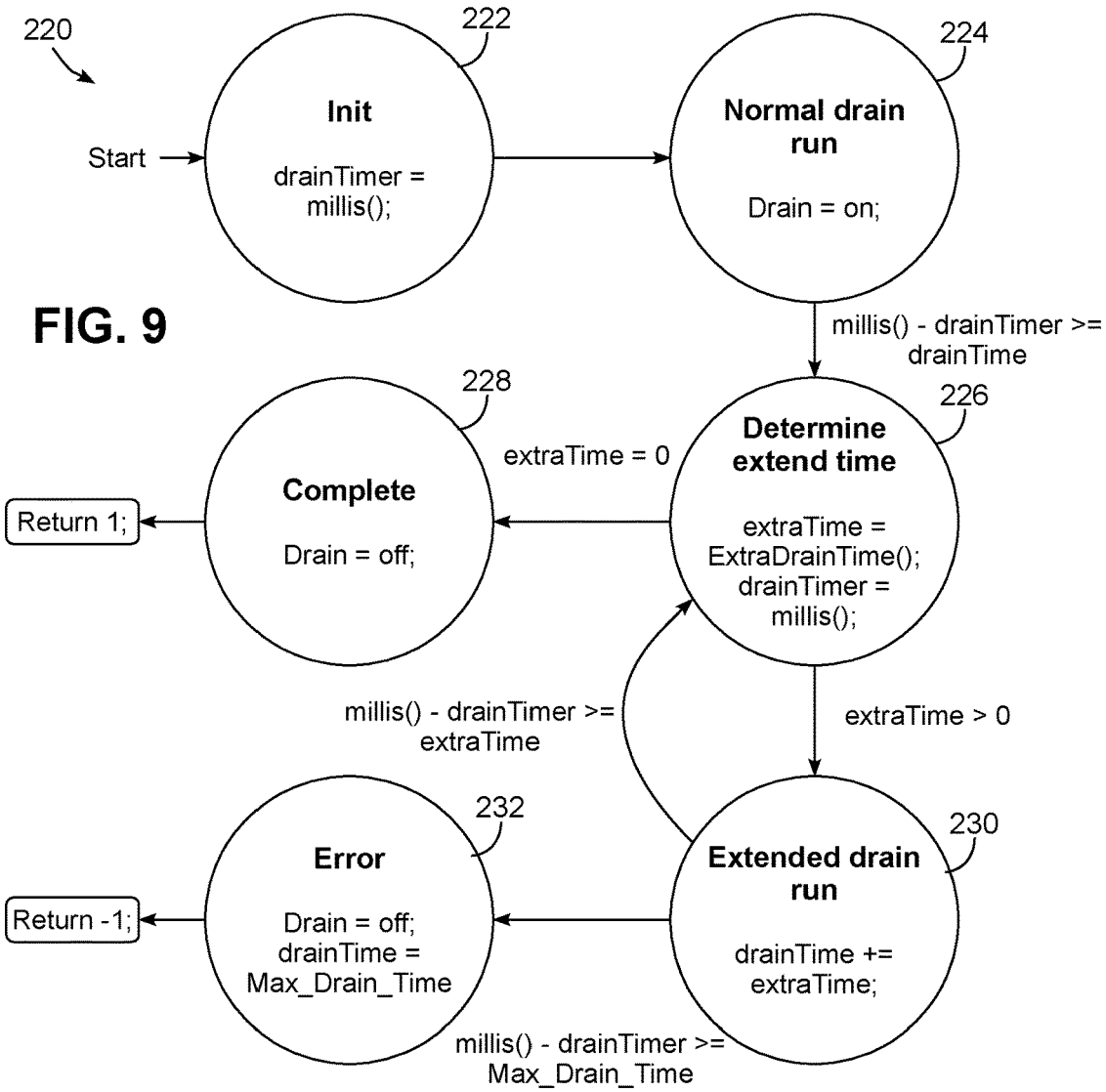
FIG. 9 is an example state machine for a drain operation capable of being performed by the laundry washing machines of FIGS. 1-4.

Now turning to FIG. 9, this figure illustrates a state diagram 220 suitable for performing a drain operation in a manner consistent with some embodiments of the invention. State diagram 220 may represent a state machine that is accessed via a function call that executes one state per call and that returns a "0" value while a drain operation is running, a "1" value when the drain operation is complete, and a "−1" value when an error occurs. The state machine includes an init state 222, a normal drain run state 224, a determine extend time state 226, a complete state 228, an extended drain run state 230, and an error state 232. When a drain operation is initiated, a load type-dependent drain time (drainTime) is provided in the initial function call, and a state transition occurs to init state 222, whereby a drainTimer variable is set to the current time in milliseconds (via a call to a millis( ) function). A transition then occurs to normal drain run state 224, where the drain system is activated (drain=on). The system remains in this state until the amount of time corresponding to the load type-dependent drain time has elapsed (determined by comparing millis( )-drainTimer to drainTime). If the drain time has elapsed, a state transition occurs to determine extend time state 226, which calls an ExtraDrainTime( ) function and stores the result in an extraTime variable, and then resets the drainTimer variable to the current time (via a call to the millis( ) function). The ExtraDrainTime( ) function (which is discussed in greater detail below in connection with FIG. 10) returns either a 0 value, representing no extra drain time needed, or a value corresponding to the extra drain time needed in milliseconds.

If no extra time is needed (extraTime=0), a state transition occurs to complete state 228, where the drain system is shut off (drain=off), and a value of "1" is returned to indicate a successful completion of the drain operation. If, however, extra time is needed (extraTime>0), a state transition occurs from state 226 to extended drain run state 230, where the value of extraTime is added to drainTime.

The system then remains in state 230 until one of two conditions occurs. First, if the extra time has elapsed (determined by comparing millis( )-drainTimer to extraTime), a state transition occurs back to state 226 to determine whether another extended drain run is required, or if the drain operation is complete. Second, if the total drain time meets a maximum time criterion (determined by comparing millis( ) drainTimer to a Max_Drain_Time constant), a state transition occurs to error state 232 to shut off the drain system (drain=off), set drainTime to Max_Drain_Time, and return a value of "−1" to indicate an error condition to the calling routine.

Figure 10:
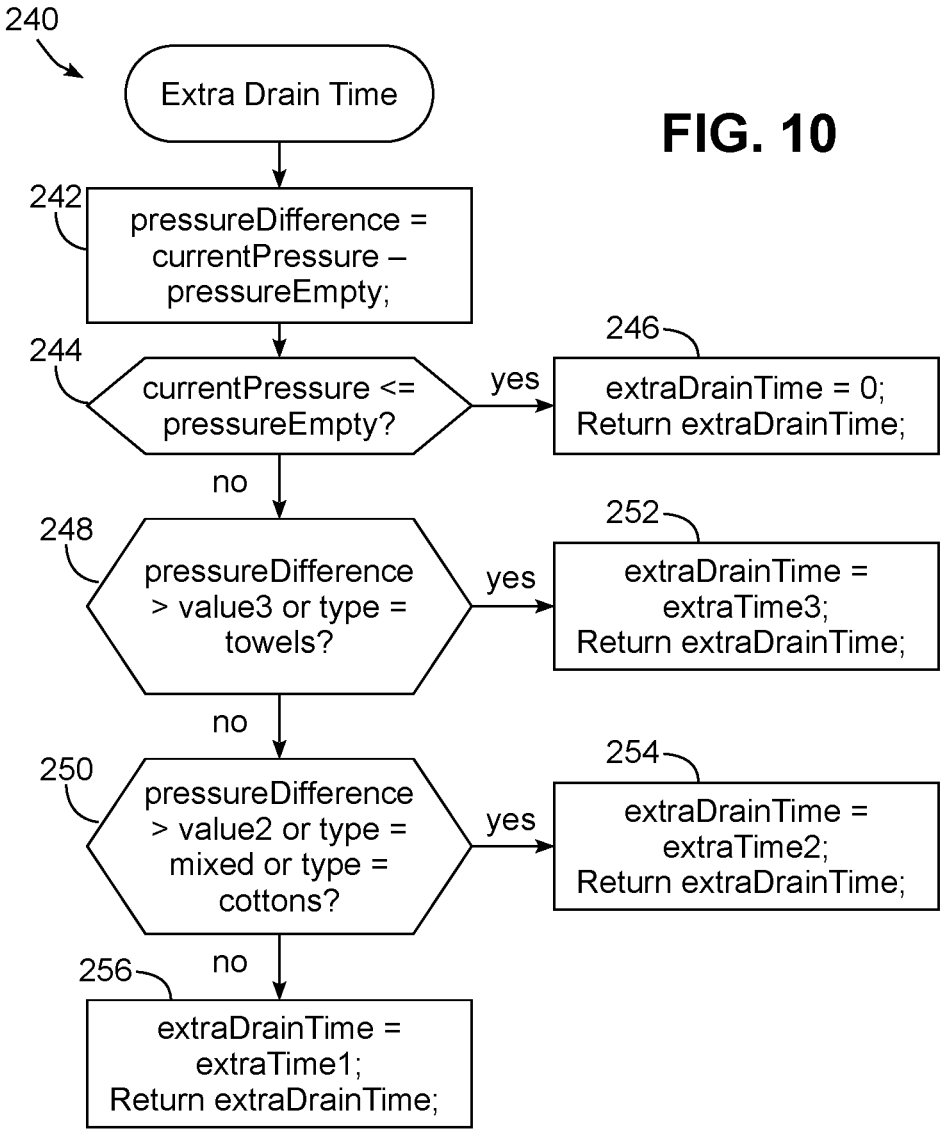
FIG. 10 is a flowchart illustrating an example sequence of operations for the extra drain time routine referenced in FIG. 9.

FIG. 10 next illustrates an example sequence of operations 240 for implementing the ExtraDrainTime( ) function referred to in state diagram 220 of FIG. 9. In this implementation, both load type and fluid level (e.g., as sensed by a pressure sensor) are considered in determining whether to extend the drain operation, and if so, for how long. First, in block 242, a pressure difference is determined by taking the difference between a currently-sensed pressure and a pressure value corresponding to an empty wash tub (pressureDifference=currentPressure−pressureEmpty). Block 244 then determines whether the current pressure meets an empty wash tub criterion, e.g., whether currentPressure<=pressureEmpty). If so, control passes to block 246 to set an extraDrainTime return variable to 0 and return the variable to the calling function to indicate that no extended drain run is required.

If not, however, one or more criteria, including one or more fluid level criteria and/or one or more load type criteria, may be used to determine an amount of extra time to return to the calling function. In this embodiment, these criteria may be used to select from different extra time values, e.g., as stored in data structure 130 of FIG. 6. Blocks 248 and 250, for example, test various combinations of criteria, and based upon whether those criteria are met, corresponding extra time values from the row 132 of data structure 130 associated with the selected load type (referred to as extraTime1, extraTime2 and extraTime3) are used.

Block 248, for example, determines whether a first fluid level criterion (pressureDifference>value3) or a first load type criterion (type=towels) is met, and if either is met, passes control to block 252 to set extraDrainTime to extraTime3 and return that value as the result of the function. Block 250 determines whether a second fluid level criterion (pressureDifference>value2) or a second load type criterion (type=mixed or type=cottons) is met, and if either is met, passes control to block 254 to set extraDrainTime to extraTime2 and return that value as the result of the function. If none of the criteria specified in blocks 248 and 250 are met (e.g., when the pressure difference is below value2 and value3 and the load type is synthetic or delicates), block 250 passes control to block 256 to set extraDrainTime to extraTime1 and return that value as the result of the function.

It will be appreciated that the combination of criteria illustrated in FIG. 10 is merely exemplary in nature. A wide multitude of other combinations of criteria based on fluid level and/or load type may be used to determine a duration of an extended drain operation in other embodiments, so the invention is not limited to the specific criteria discussed herein.

Various additional modifications may be made to the illustrated embodiments consistent with the invention. Therefore, the invention lies in the claims hereinafter appended.

What is claimed is:

1. A laundry washing machine, comprising:

a wash tub disposed within a housing;

a drain system configured to drain fluid from the wash tub; and a controller coupled to the drain system and configured to initiate a drain operation with the drain system to drain fluid from the wash tub during a wash cycle, wherein the controller is further configured to select a load type for a load disposed in the wash tub from among a plurality of load types, and control a time of the drain operation at least in part based upon the selected load type, wherein the controller is configured to initiate the drain operation during a spin operation, and wherein the time of the drain operation is different from a time of the spin operation.

2. The laundry washing machine of claim 1, wherein the drain system includes a pump, and wherein the controller is configured to control the time of the drain operation by operating the pump for the controlled time.

3. The laundry washing machine of claim 1, wherein the controller is further configured to control the spin operation using a spin profile determined at least in part based on the selected load type.

4. The laundry washing machine of claim 3, wherein the spin profile defines a plurality of spin segments and the spin profile includes a first spin speed associated with a first spin segment of the plurality of spin segments, wherein the drain operation is a first drain operation associated with the first spin segment and the time of the drain operation is a first time of the first drain operation, and wherein the controller is further configured to initiate a second drain operation during a second segment of the plurality of spin segments, control a second spin speed for the second spin segment at least in part based on the selected load type, and control a second time of the second drain operation at least in part based upon the selected load type.

5. The laundry washing machine of claim 4, further comprising a data structure storing, for each of the plurality of load types, a plurality of spin speeds and a plurality of times for drain operations, and wherein the controller is further configured to determine the first and second spin speeds and the first and second times by accessing a portion of the data structure associated with the selected load type.

6. The laundry washing machine of claim 1, wherein the controller is configured to select the load type by automatically and dynamically selecting the load type based at least in part on one or more times determined during an initial fill phase of the wash cycle.

7. The laundry washing machine of claim 6, wherein the controller is configured to automatically and dynamically select the load type based at least in part on the one or more times determined during the initial fill phase by controlling a water inlet to dispense water into the wash tub, determining a first time at which a predetermined fluid level is sensed in the wash tub while the controller controls the water inlet to dispense water into the wash tub, and determining a peak time that is calculated based at least in part on a time elapsed between the controller controlling the water inlet to stop dispensing water into the wash tub and a stabilization of fluid level being sensed.

8. A laundry washing machine comprising:

a wash tub disposed within a housing;

a drain system configured to drain fluid from the wash tub; and a controller coupled to the drain system and configured to initiate a drain operation with the drain system to drain fluid from the wash tub during a wash cycle, wherein the controller is further configured to select a load type for a load disposed in the wash tub from among a plurality of load types, and control a time of the drain operation at least in part based upon the selected load type;

wherein the controller is configured to control the time of the drain operation at least in part based upon the selected load type by retrieving a predetermined time associated with the selected load type.

9. The laundry washing machine of claim 8, further comprising a data structure storing at least one time for each of the plurality of load types, and wherein the controller is configured to retrieve the predetermined time associated with the selected load type by accessing the data structure.

10. A laundry washing machine, comprising:

a wash tub disposed within a housing;

a drain system configured to drain fluid from the wash tub; and a controller coupled to the drain system and configured to initiate a drain operation with the drain system to drain fluid from the wash tub during a wash cycle, wherein the controller is further configured to select a load type for a load disposed in the wash tub from among a plurality of load types, and control a time of the drain operation at least in part based upon the selected load type;

wherein the controller is configured to control the time of the drain operation at least in part based upon the selected load type by:

controlling the drain system to drain fluid from the wash tub for a predetermined time associated with the selected load type;

thereafter determining if the wash tub is empty;

if the wash tub is determined to be empty, ending the drain operation; and if the wash tub is not determined to be empty, controlling the drain system to drain fluid from the wash tub for an extended time.

11. The laundry washing machine of claim 10, wherein the controller is further configured to end the drain operation in response to determining that the drain operation has met a maximum time criterion.

12. The laundry washing machine of claim 11, wherein the controller is further configured to signal an error in response to determining that the drain operation has met the maximum time criterion.

13. The laundry washing machine of claim 10, wherein the controller is further configured to determine the extended time based at least in part on an amount of fluid sensed in the wash tub when determining if the wash tub is empty.

14. The laundry washing machine of claim 10, wherein the controller is further configured to determine the extended time based at least in part on the selected load type.

15. The laundry washing machine of claim 14, wherein the controller is configured to determine the extended time based at least in part on the selected load type by:

sensing a fluid level in the wash tub using a pressure sensor;

selecting a first predetermined time for the extended time in response to the sensed fluid level meeting a first fluid level criterion or the selected load type meeting a first load type criterion;

selecting a second predetermined time for the extended time in response to the sensed fluid level meeting a second fluid level criterion or the selected load type meeting a second load type criterion; and selecting a third predetermined time for the extended time in response to the selected load type not meeting any of the first and second fluid level criteria and the first and second load type criteria.

* * * * *